US005647185A

United States Patent [19]

Forlini

[11] Patent Number: 5,647,185

[45] Date of Patent: Jul. 15, 1997

[54] STRUCTURAL BLOCKS AND ASSEMBLIES THEREOF

[76] Inventor: Emidio J. Forlini, 120 Edmonds Ave., Havertown, Pa. 19083

[21] Appl. No.: 645,931

[22] Filed: May 14, 1996

Related U.S. Application Data

[63] Continuation of Ser. No. 504,057, Jul. 18, 1995, abandoned, which is a continuation of Ser. No. 154,943, Nov. 19, 1993, abandoned.

[51] Int. Cl.[6] ..... A63H 33/04; E04C 1/00

[52] U.S. Cl. ..... 52/604; 52/125.4; 52/592.6; 52/607; 405/284; 446/102; 446/128

[58] Field of Search ..... 52/604–609, 592.6, 52/596, 125.4, 125.6; 405/284, 286, 276, 262; 446/102, 128, 124

[56] References Cited

U.S. PATENT DOCUMENTS

| | | | |
|---|---|---|---|
| 349,646 | 9/1886 | Grigg . | |
| 721,441 | 2/1903 | Hayhow . | |
| 797,205 | 8/1905 | Inman | 52/607 X |
| 1,339,596 | 5/1920 | Depatie . | |
| 1,514,081 | 11/1924 | Hahn . | |
| 2,720,104 | 10/1955 | Cameron | 52/592.6 |
| 2,772,560 | 12/1956 | Neptune | 52/125.4 |
| 2,970,218 | 1/1961 | Shaw | 250/108 |
| 3,025,641 | 3/1962 | Ahtianen . | |
| 3,220,141 | 11/1965 | Goss, III | 52/592.6 |
| 3,422,588 | 1/1969 | Stewart, Jr. | 52/285 |
| 3,534,518 | 10/1970 | Zagray | 52/592.6 |
| 4,314,431 | 2/1982 | Rabassa | 52/259 |
| 4,651,485 | 3/1987 | Osborne | 52/284 |
| 4,660,344 | 4/1987 | Gaudelli et al. | 52/125.4 |
| 4,787,185 | 11/1988 | Gascho | 52/233 |
| 4,860,505 | 8/1989 | Bender | 52/98 |
| 4,990,116 | 2/1991 | Chen | 446/124 |
| 5,060,428 | 10/1991 | Arthur, Jr. et al. | 52/125.6 |
| 5,061,218 | 10/1991 | Garage et al. | 446/102 |
| 5,069,647 | 12/1991 | Zuviria | 446/127 |

FOREIGN PATENT DOCUMENTS

| | | |
|---|---|---|
| 310449 | 8/1933 | Italy . |
| 74813 | 4/1917 | Switzerland . |
| 204263 | 9/1923 | United Kingdom . |

*Primary Examiner*—Carl D. Friedman
*Assistant Examiner*—Winnie Yip
*Attorney, Agent, or Firm*—Alfred Stapler; Lipton & Stapler

[57] ABSTRACT

A generally rectangular structural block has a central ridge which extends along the top of the block and stops short of its end faces. In the bottom face are two grooves, one aligned with the ridge, the other at a right angle and intersecting in the middle of the bottom face. The groove aligned with the ridge extends from end-to-end of the block, the intersecting groove stops short of one side face of the block. The grooves are dimensioned so as to mate with a ridge dimensioned like that on the top face. Two or more such blocks can be made as a permanently joined unit, their ridges in line with each other, and the side faces at which the intersecting grooves stop short located on the same side of the unit. Single-block and multi-block units are laid up to form walls with the ridges in a given course interlocking with the grooves in the next higher course of blocks.

18 Claims, 2 Drawing Sheets

STRUCTURAL BLOCKS AND ASSEMBLIES THEREOF

This is a continuation of application Ser. No. 08/504,057 filed on Jul. 18, 1995, now abandoned, which is a continuation of Ser. No. 08/154,943 filed on Nov. 19, 1993 now abandoned.

BACKGROUND OF THE INVENTION

The present invention relates to blocks useful for structural purposes, such as walls, and more particularly to such blocks which are made of poured concrete and configured so as to interlock to form a sturdy wall construction.

There are many situations in which it is desirable to construct walls by simply stacking wall blocks in courses upon one another, and yet have these walls be sturdy and resistant even to strong sideways forces which may tend to act upon them.

For example, it is desirable that retaining walls for earth embankments, or for the storage of sand, gravel, or the like, be capable of being made from a single row of stacked blocks, while being highly resistant to the forces which the material being retained exerts upon the wall.

If such blocks are flat-faced, then the only factor which contributes to such resistance is the friction between adjoining blocks, which is a function of their weight and surface roughness.

Weight can obviously not be increased indefinitely. Surface roughness is also not unlimited because, if excessive, it permits the escape, between adjoining blocks, of the material to be retained and it can even be the cause of reduced friction.

The prior art has therefore proposed the use of blocks which are not flat-faced, but which exhibit various configurations of "ins and outs" so that, when the blocks are stacked to form a wall, these ins and outs will interlock and thereby provide the desired structural sturdiness. However, these block configurations have left something to be desired. In some cases the specific configurations were quite complicated and therefore difficult and expensive to manufacture. In other cases, several different configurations had to be provided to form corners in the walls to be erected from these blocks. In still other cases, the configurations of ins and outs were simply inadequate for the task and had to be supplemented by separate reinforcing means.

SUMMARY OF THE INVENTION

Accordingly, it is an object of the present invention to provide structural blocks which overcome one or more of the drawbacks of the prior art.

It is another object of the invention to provide such blocks which are of relatively simple and uniform configuration.

It is another object to provide walls constructed of such blocks.

It is another object to provide such wails which have corners formed of blocks having the same configuration as those which form straight wall portions.

These and other objects which will appear are achieved in accordance with the present invention as follows.

A structural block embodying the invention is generally rectangular. On its top face there is a central ridge which extends lengthwise of the block and which stops short of both end faces of the block. In the bottom face of the block there are two grooves, one aligned with the top face ridge, the other at right angles thereto. These grooves intersect in the middle of the bottom face. The groove aligned with the ridge extends from end-to-end of the block, the intersecting groove preferably stops short of one side face of the block. The width and depth of the grooves are dimensioned so as to mate with a ridge having dimensions like those of the ridges in the top face of the block.

Two or more such blocks can be made as a permanently joined multi-block unit, their ridges being in line with each other, and the side faces at which the intersecting grooves stop short being located on the same side of the unit.

Single-block and multi-block units are laid up to form walls with the ridges in a given course interlocking with the grooves in the next higher course of blocks.

BRIEF DESCRIPTION OF THE DRAWINGS

For further details, reference is made to the discussion which follows, in light of the accompanying drawings, wherein.

The same reference numerals are used to designate similar elements in the several figures.

DETAILED DESCRIPTION OF THE PREFERRED EMBODIMENTS

Figure 1:
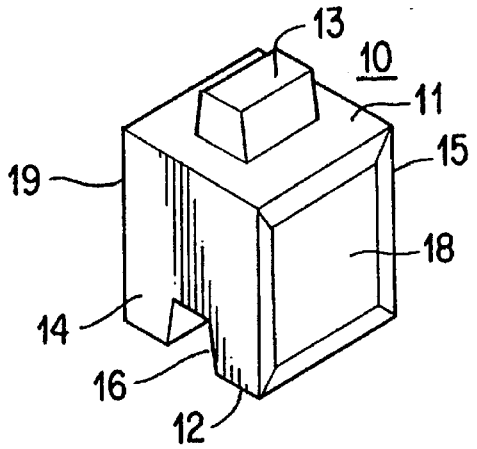
FIG. 1 shows a block embodying the invention in isometric view seen from above.
Figure 2:
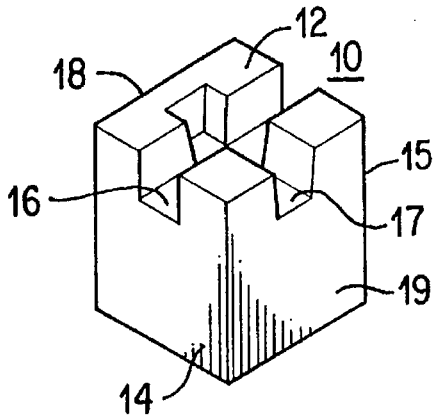
FIG. 2 shows the block of FIG. 1 seen from below.

Referring now jointly to FIGS. 1 and 2, these both show the same block 10. The face of the block 10 which is uppermost in FIG. 1 will be referred to as its top face 11. The opposite face, which is not visible in FIG. 1 but is instead visible in FIG. 2, will be referred to as its bottom face 12. These designations are not only the result of the way the block 10 is positioned in FIGS. 1 and 2, but are also consistent with the way this type of block is normally used in structural assemblies, such as walls. In such assemblies, the blocks 10 are usually positioned as shown in FIG. 1, i.e. with top face 11 upward and bottom face 12 downward. In FIG. 2, face 12 has been shown facing upward only to make it easier to illustrate its configuration in accordance with the present invention.

Referring again to FIG. 1, this shows a central ridge 13 which projects above top face 11 and which extends perpendicularly to flat end faces 14 and 15 (the latter being not visible in FIGS. I or 2), but stops short of these end faces.

In FIG. 2, there are shown two grooves 16 and 17, the former aligned with ridge 13, the latter at right angles to same. Groove 16 extends all the way to both end faces 14 and 15; groove 17 stops short of side face 18, but extends all the way to side face 19.

Thus, end faces 14 and 15 and side face 19, in effect, have notches in them, created by the ends of grooves 16 and 17, whereas side face 18 does not have such a notch. Preferably side face 18 is beveled at the edges where it joins the other faces.

The internal dimensions of grooves 16 and 17 conform closely enough to the external dimensions of ridge 13 so that, when two blocks 10 are placed on top of each other with their respective top and bottom faces in contact, the ridge 13 of the lower block fits into and mates with one or the other of grooves 16 and 17 of the upper block, depending on which of these grooves is brought into alignment with that ridge 13.

Moreover, as shown in the drawings, both ridge 13 and the grooves 16 and 17 preferably have slightly tapered sides. This facilitates their inter-engagement when blocks are placed on top of each other as discussed above.

Figure 3:
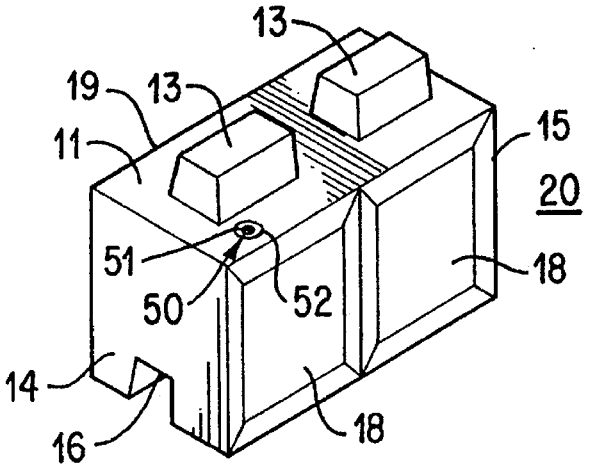
FIGS. 3 and 4 show units of two such blocks, respectively seen from above and below.
Figure 4:
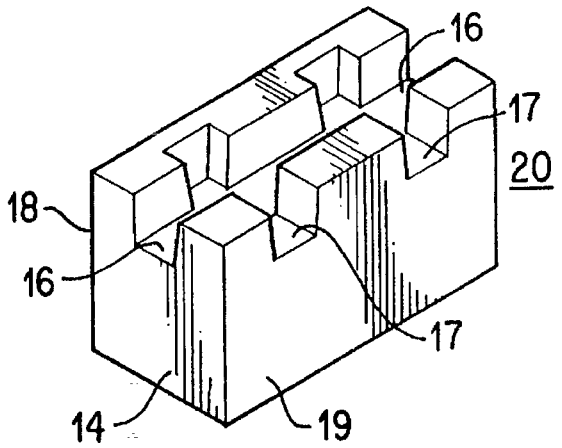

Referring now jointly to FIGS. 3 and 4, these show a top and bottom view, respectively of an embodiment of the invention characterized by a unitary block 20 which is, in effect, the equivalent of two blocks 10, permanently joined end-to-end. Thus, block 20 has two ridges 13, two sets of grooves 16 and 17 intersecting at right angles to each other, etc. Grooves 16 actually connect with each other, as seen in FIG. 4. Closed side faces 18 are located immediately next to each other.

It should be noted that block 20 of FIGS. 3 and 4 need not be made by separately manufacturing blocks 10 and then joining them together. Rather, block 20 is preferably made in one piece, by casting in a suitably shaped mold.

Further, it will be understood that the present invention is not limited to providing blocks 20 equivalent to two blocks 10 joined together. Rather, the invention may also be embodied in blocks which are equivalent to three, four or even more of blocks 10 permanently joined together end-to-end.

Such unitary blocks, equivalent to multiple blocks 10, are especially useful in wall constructions. They make it possible to provide interlocking between successive courses of such blocks in a way which further strengthens the overall wall structure, as explained in more detail below with reference to FIG. 5. The use of such multi-block units also reduce the burden of block handling, since fewer individual blocks need to be positioned to form a wall of a given size than if only single blocks 10 were used.

Figure 5:
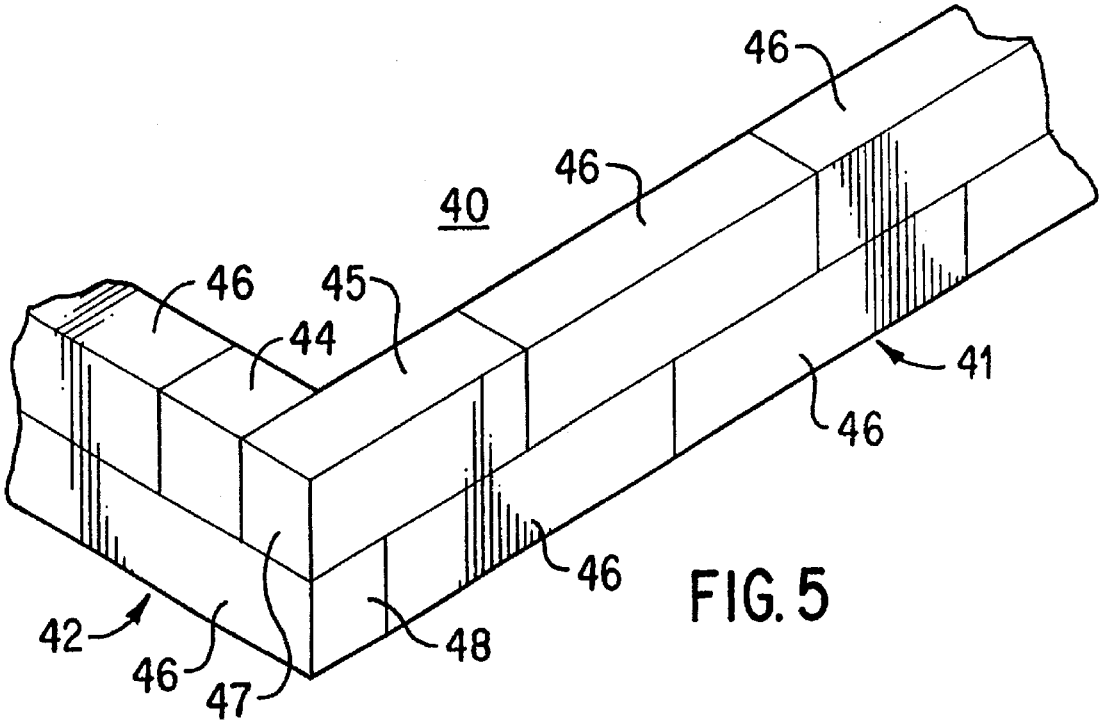
FIG. 5 shows, in highly diagrammatic form, an isometric view of a wall segment laid up of blocks embodying the invention.

Referring now to FIG. 5, this diagrammatically illustrates a wall segment 40 made up of blocks embodying the present invention. This wall segment 40 includes a front portion 41, and a side portion 42 which forms a right-angle corner with front portion 41.

FIG. 5 is intended to diagram the pattern in which positioning of the various blocks embodying the present invention may be positioned to form the wall segment 40. Therefore, the details of their individual configurations have not been shown in FIG. 5. However, it will be understood that these details are like those shown in FIGS. 1 through 4. That is, each block in FIG. 5 encompasses one or more ridges 13 and grooves 16 and 17, closed side face 18, etc.

Specifically, the block designated by reference numeral 44 in FIG. 5 is constructed so as to be the equivalent of a single block 10 (FIGS. 1 and 2); the block 45 in FIG. 5 is constructed as the equivalent of three such blocks 10, permanently joined end-to-end; each block 46 is equivalent to four blocks 10 permanently joined end-to-end. The blocks in FIG. 5 are preferably so oriented that where possible the faces with beveled edges, corresponding to face 18 in FIG. 1, face toward the viewer. Thus, they present to the viewer a nearly uninterrupted facade of adjoining faces 18. The only interruptions would be due to the open ends of grooves 16 (FIG. 1) which terminate at the end faces 47 and 48 of those blocks 45 and 46 which form the corner of the wall. These open ends can be filled with material like that of the blocks themselves, thereby eliminating even these interruptions in the wall facade.

In FIG. 5, only two courses of blocks have been illustrated. If the wall 40 is to be higher, then additional courses can be added, alternating between the two particular course patterns of FIG. 5.

As is shown in FIG. 5, the pattern in which the blocks are positioned is such that the junctions between adjacent blocks in one course are never in line with the junctions between adjacent blocks in the other course. This is made possible by the use of some multi-unit blocks 45 and 46 and, as previously noted, contributes to the overall sturdiness of the wall structure.

The blocks embodying the present invention are typically made of concrete, cast in appropriately shaped molds. Thus, block 10 may be cast in a 2×2×2 foot format (not counting ridge 13) and may weigh approximately 2,000 lbs. Block 20, being twice as long, would then be 2×2×4 feet and weigh about 4,000 lbs. Blocks 45 and 46 in FIG. 5 would be proportionately longer and heavier. Obviously, walls made of such blocks are quite sturdy, especially when both vertically and horizontally interlocked by means of their respective ridges and grooves as described above.

Figure 6:
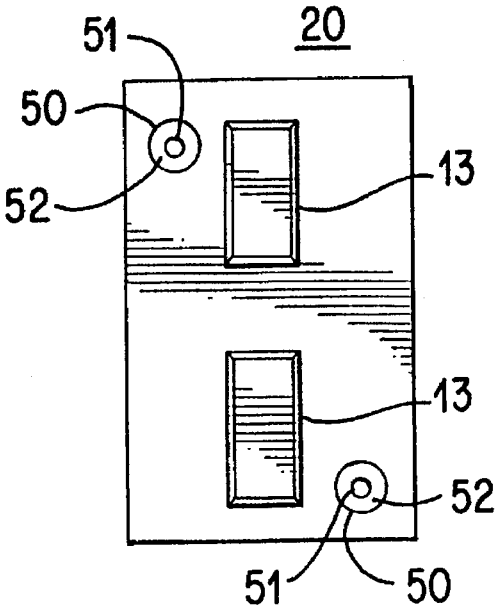
FIG. 6 shows a top view of the block of FIG. 3.

In order to facilitate movement of these blocks into position next to and above one another, the blocks embodying the present invention are preferably equipped with lifting anchors embedded in their top surfaces. Referring again to FIG. 3, one such anchor 50 is visible in that Figure. It has an enlarged head 51, which enables it to be grasped by a conventional lifting hook (not shown). Anchor 50 is recessed in a generally hemispherical recess 52 formed in the top surface of block 20, so that the anchor does not to protrude above that top surface. For balance when lifting the blocks by means of anchor 50, a similar anchor is located diagonally opposite, symmetrically positioned with respect to the center of the top face of the block. However, this other anchor is not visible in FIG. 3, being concealed from view by the rearward one of ridges 13. Both anchors 50 are visible in the top view of FIG. 6.

It will be understood that many modifications may be made by those skilled in the art without departing from the present inventive concept.

Thus, the individual blocks embodying the invention may be made in a wide variety of sizes and materials, depending on the specific application for which they are to be used. The walls made from these blocks may have various shapes and various patterns of block positioning. While a wall made of only two courses of blocks has been shown, many more courses can be provided, and so forth. Accordingly, it is desired that the scope of the invention be limited only by the appended claims.

What is claimed is:

1. A generally rectangular structural block having a top and a bottom face, and having:

a substantially rectangular ridge which extends with uniform height above said top face, which is substantially centered within said top face and which is substantially narrower and shorter than said top face of the block;

a pair of grooves which are formed with uniform depth in said bottom face, one of said grooves being aligned with and the other of said grooves being at right angles to said ridge, and said grooves intersecting substantially in the center of said bottom face, each groove being dimensioned in width and depth substantially as the female mate to said ridge; and said ridge having a length which is sufficiently greater than its width so that said block is able to slide along the aligned groove, but is kept by said ridge from sliding at right angles to the long dimension of said ridge when the block is stacked together with another block of the same construction.

2. The block of claim 1 wherein the groove aligned with said ridge extends the full length of the block, and the groove at right angles to said ridge stops short of one side of the block, whereby said side of the block has a face with no groove opening therein.

3. The block of claim 2, wherein said right angle groove extends to the side of said block opposite said one side, whereby said opposite side has a face with the end of said groove opening therein.

4. The block of claim 2 wherein the face with no groove opening therein has beveled edges.

5. The block of claim 1 further having a plurality of said ridges spaced longitudinally apart along the top face of the block and wherein for each ridge there is a pair of said grooves dimensioned as the female mates to the ridge.

6. The block of claim 5 wherein the grooves aligned with the ridges are connected to each other.

7. The block of claim 6 wherein each right angle groove stops short of the same side of the block.

8. A unitary structural block equivalent to at least two of the rectangular blocks according to claim 1, permanently joined end-to-end to form said unitary block.

9. The block of claim 8 equivalent to three of said blocks according to claim 1.

10. The block of claim 8 equivalent to four of said blocks according to claim 1.

11. A set of blocks, each of said blocks being a generally rectangular structure having a top and a bottom face, a plurality of substantially rectangular ridges which extend with uniform height above said top face, which are substantially centered within said top face and which are substantially narrower and shorter than said top face of the block, said ridges being spaced longitudinally apart along the top face of the block, and a plurality of grooves which are formed with uniform depth in said bottom face, one of said plurality being aligned with said ridges, and the others of said grooves intersecting substantially at right angles and opposite the centers of said rectangular ridges, each groove being dimensioned substantially in width and depth as the female mate to a said ridge and each right angle groove stopping short of the same side of the block; and each said ridge having a length which is sufficiently greater than its width so that the block of said set are able to slide alone the aligned grooves, but are kept by said ridge from sliding at right angles to the long dimension of said ridge when the set of blocks is stacked with another set of blocks of the same construction.

12. The set of blocks of claim 11 wherein said blocks are stacked on each other in courses, the ridge on at least one block being engaged by that groove of the block stacked thereon which is aligned with the ridge on said last-named block.

13. The set of block of claim 11 wherein said blocks are stacked on each other in courses, the ridge on at least one block being engaged by that groove of the block stacked thereon which is at right angles to the ridge on said last-named block.

14. The set of block of claim 11 forming a wall of said blocks.

15. The set of block of claim 14 wherein the blocks are positioned in such a pattern that the junctions between adjoining blocks in one course are not aligned with the junctions between adjoining blocks in the next course.

16. The set of block of claim 14 wherein several adjoining blocks are oriented with their faces having no groove ending therein facing in the same direction.

17. The wall formed by the set of block of claim 14 wherein a block in every other course is oriented with its ridge at right angles to the ridge in the block beneath, thereby forming a corner in the wall of stacked blocks.

18. A generally rectangular structural block having a top and a bottom face, and having:

a substantially rectangular ridge which extends with uniform height above said top face, which is substantially centered within said top face and which is substantially narrower and shorter than said top face of the block;

a pair of grooves which are formed with uniform depth in said bottom face, one of said grooves being aligned with and the other of said grooves being at right angles to said ridge, and said grooves intersecting substantially in the center of said bottom face, each groove being dimensioned in width and depth substantially as the female mate to said ridge; and said ridge having a length which is sufficiently greater than its width so that said block is able to slide along the aligned groove but is kept by said ridge from sliding at right angles to the long dimension of said ridge when the block is stacked together with another block of the same construction, said block having at least one pair of lifting anchors embedded therein, said anchors being recessed in depressions formed in the top face of the block, the different members of the pair of anchors being located diagonally opposite each other, symmetrically with respect to the ridge extending above the center of said top face.

* * * * *

UNITED STATES PATENT AND TRADEMARK OFFICE

CERTIFICATE OF CORRECTION

PATENT NO. : 5,647,185
DATED : July 15, 1997
INVENTOR(S) : Emidio J. Forlini

It is certified that error appears in the above-indentified patent and that said Letters Patent is hereby corrected as shown below:

Column 5, line 44, the word "block" should be replaced with the word --blocks--

Column 5, line 45, the word "alone" should be replaced with the word --along--

Column 6, line 4, the word "block" should be replaced with the word --blocks--

UNITED STATES PATENT AND TRADEMARK OFFICE

CERTIFICATE OF CORRECTION

PATENT NO. : 5,647,185

DATED : July 15, 1997

INVENTOR(S) : Emidio J. Forlini

It is certified that error appears in the above-indentified patent and that said Letters Patent is hereby corrected as shown below:

Column 6, line 9, the word "block" should be replaced with the word --blocks--

Column 6, line 11, the word "block" should be replaced with the word --blocks--

Column 6, line 15, the word "block" should be replaced with the word --blocks--

Column 6, line 18, the word "block" should be replaced with the word --blocks--

Signed and Sealed this

Eleventh Day of November, 1997

*Attest:*

Bruce Lehman

BRUCE LEHMAN

*Attesting Officer*

*Commissioner of Patents and Trademarks*